United States Patent [19]

Fontet et al.

[11] Patent Number: 4,971,754

[45] Date of Patent: Nov. 20, 1990

[54] METHOD OF PREPARING AN ELECTRICAL CONTACT MATERIAL, AND A METHOD OF MANUFACTURING A CONTACT ELEMENT INCORPORATING SUCH A MATERIAL

[75] Inventors: Gerard Fontet, Saint Gervais; Michel Leclercq; Jacques Muniesa; Thierry Pagnier, all of Nanterre; Tretarre Rene, Agde, all of France

[73] Assignee: Telemecanique, France

[21] Appl. No.: 440,177

[22] Filed: Nov. 22, 1989

[30] Foreign Application Priority Data

Nov. 22, 1989 [FR] France ..... 88 15163

[51] Int. Cl.[5] ..... B22F 7/00

[52] U.S. Cl. ..... 419/8; 419/21; 419/22; 419/28; 419/29; 419/38; 419/39; 419/43

[58] Field of Search ..... 75/363, 369, 252; 252/512, 514; 419/8, 21, 38, 28, 39, 29, 43, 22

[56] References Cited

U.S. PATENT DOCUMENTS

| | | | |
|---|---|---|---|
| 3,954,459 | 5/1976 | Schreiner et al. | 75/206 |
| 4,056,365 | 11/1977 | Bevington et al. | 428/565 |
| 4,341,556 | 7/1982 | Bohm et al. | 252/514 |
| 4,396,420 | 8/1983 | Schmidberger et al. | 75/355 |
| 4,452,651 | 6/1984 | Shibata | 148/431 |
| 4,452,652 | 6/1984 | Shibata | 148/431 |
| 4,565,590 | 1/1986 | Grosse et al. | 148/431 |
| 4,681,702 | 7/1987 | Shcreiner et al. | 252/518 |
| 4,824,600 | 4/1989 | Kock et al. | 252/313.1 |

FOREIGN PATENT DOCUMENTS

| | | |
|---|---|---|
| 0250784 | 7/1988 | European Pat. Off. . |
| 2123033 | 1/1984 | United Kingdom . |

*Primary Examiner*—Stephen J. Lechert, Jr.
*Assistant Examiner*—Leon Nigoshosian, Jr.
*Attorney, Agent, or Firm*—William A. Drucker

[57] ABSTRACT

The method concerns preparing a contact material constituted by silver and tin oxide.

According to the invention the method comprises the following steps:

- preparing an aqueous solution containing dissolved silver nitrate and tin oxide particles in suspension, with the size of said particles measured in terms of specific surface area using the BET method lying between about 2 $m^2/g$ and 6 $m^2/g$;
- causing silver nitrate to precipitate in silver hydroxide by rapidly adding a strong base and stirring, with silver hydroxide being unstable and transforming progressively into silver oxide;
- eliminating the ions from the solution and then the water in order to obtain a dry product; and
- heating the dry product to a temperature of about 200° C. to 500° C. in order to reduce the silver oxide to metallic silver.

The invention is applicable to manufacturing electrical contacts for opening and closing in electromechanical apparatuses.

13 Claims, No Drawings

METHOD OF PREPARING AN ELECTRICAL CONTACT MATERIAL, AND A METHOD OF MANUFACTURING A CONTACT ELEMENT INCORPORATING SUCH A MATERIAL

The present invention relates in general to manufacturing electrical contacts, e.g. in the form of pellets, suitable for being used in switching devices which open and close in succession.

The invention relates more precisely to improvements to a method of preparing a contact material and to manufacturing contact elements such as pellets, or bars, or the like incorporating such a material.

BACKGROUND OF THE INVENTION

When an electromechanical control apparatus is opened or closed while live, an electric arc occurs. Repeated arcing is disadvantageous in that it erodes contacts progressively, and it also modifies the surface composition of the contacts, thereby leading to changes in contact resistance and thus to the danger of heating which is undesirable from the safety point of view. In addition, and above all, the presence of such arcing on closure runs the danger of dynamically bonding or welding together the two contact elements.

The contact materials most frequently used in low tension electromechanical apparatuses are composite silver/metal oxide materials, written $AgMeO_n$. Silver is an excellent conductor of electricity, does not oxidize in air, and possesses sufficient malleability to withstand without damage the numerous mechanical shocks to which it is exposed in such an environment. The metal oxide is mainly present for reducing the danger of bonding compared with using pure silver. In addition, these composite materials are eroded away by arcing at a slower rate than is pure silver.

Heretofore, most contacts for power control apparatuses have been made of a composite silver/cadmium oxide material (AgCdO). However, because of the toxicity of cadmium, and also in order to improve the quality of these materials, attempts have been made to replace cadmium by some other metal. Tin turns out to be suitable on several counts.

However, it turns out that $AgSnO_2$ materials tend to increase heating in the apparatuses because of the increased contact resistance between two facing pellets.

It is therefore conventional to add another oxide, generally $WO_3$ or $MoO_3$ to the contact element in order to mitigate this drawback.

However, this addition is disadvantageous in that it complicates the manufacture of contacts and makes such manufacture more expensive.

The object of the present invention is to mitigate these drawbacks of the prior art and to propose a method of preparation which makes it possible to obtain a contact material of the $Ag/SnO_2$ type having improved properties.

More precisely, in spite of the above-mentioned drawbacks related to using $SnO_2$ on its own in a silver-based composite material, the Applicant has continued research on $AgSnO_2$ composite material and has discovered that under certain conditions it is possible to obtain an $AgSnO_2$ composite which is at least as satisfactory as an AgCdO composite with respect to mechanical and electrical behavior, and that this can be done without there being any need to add additional oxides such as $WO_3$ or $MoO_3$ in order to avoid arcing problems.

SUMMARY OF THE INVENTION

Thus, the present invention provides a method of preparing a contact material constituted by silver and tin oxide, the method comprising the following steps:

preparing an aqueous solution containing dissolved silver nitrate and tin oxide particles in suspension, with the size of said particles measured in terms of specific surface area using the BET method lying between about 2 square meters per gram ($m^2/g$) and 6 $m^2/g$;

causing silver nitrate to precipitate in silver hydroxide by rapidly adding a strong base and stirring, with silver hydroxide being unstable and transforming progressively into silver oxide;

eliminating the ions from the solution and then the water in order to obtain a dry product; and heating the dry product to a temperature of about 200° C. to 500° C. in order to reduce the silver oxide to metallic silver.

In addition, preferred aspects of the preparation method of the invention are as follows:

the concentration of silver in the final contact material is about 84% to 92% by weight, with the remainder being tin oxide;

the strong base is concentrated sodium hydroxide; and the step of heating the dry product is performed at a temperature and for a duration such as to cause the silver and the tin oxide to agglomerate.

The invention also relates to manufacturing contact elements comprising the material prepared by the above method, together with a thin underlayer of pure silver. More precisely, the invention provides a method in which the material and the underlayer are subjected to the following operations:

compression at about 3 metric tons per square centimeter ($t/cm^2$);

sintering for 30 min to 40 min at a temperature of about 840° C;

first calibration at about 10 $t/cm^2$;

first annealing for about 30 min at about 900° C;

second calibration at about 12 $t/cm^2$; and second annealing for about 30 min at about 940° C.

The invention also provides a method of manufacture characterized in that together with a thin underlayer of pure silver, the method being characterized in that it comprises the steps of:

adding a low concentration of copper oxide to the prepared material; and compressing the resulting material together with said underlayer in order to form said element, and heating the said element to a temperature lying between 940° C and 960° C, thereby giving rise to a minority liquid phase in which the element is sintered.

Preferred aspects of this manufacturing method are the following:

the copper oxide is added to the prepared material by adding copper nitrate to the aqueous solution, such that during the precipitation step, copper hydroxide is precipitated and is subsequently transformed into copper oxide;

the copper oxide is present in the prepared material at a concentration of about 0.1% to 1.0% by weight; it includes a subsequent step of calibration by compression;

it includes a final annealing step for releasing stresses; and for manufacturing bars from which pellets can be cut off, the method further includes at least one succession of rolling and annealing steps.

Other aspects, objects, and advantages of the present invention appear more clearly on reading the following detailed description of preferred implementations of the invention given by way of non-limiting example.

DETAILED DESCRIPTION

Research performed by the Applicant has shown that it is possible to make contact elements from composite silver/tin oxide material $AgSnO_2$ having performance which is equivalent to or better than the performance of silver/cadmium oxide contacts, both with respect to welding and to erosion, and that this is achieved with contact resistances which are kept down to acceptable levels.

In accordance with an essential aspect of the present invention, these advantageous characteristics are obtained:

(a) by using very fine grains of silver and of tin oxide, with a grain size of not more than about 1 micron; and (b) by causing the two components to be very highly dispersed.

Simultaneously, it is necessary (c) to select a grain size which is big enough for the mechanical characteristics of the pellet to be suitable, in particular to enable it to withstand mechanical shocks without being too hard.

Requirements (a) and (c) appear to be contradictory, thereby making it necessary to find a compromise, in particular by varying the size of the tin oxide grains, while leaving the size of the silver grains relatively small.

More precisely, if the $SnO_2$ grains are very small, the pellet is very hard and therefore brittle, having high contact resistance and therefore running the risk of heating up, however the risk of dynamic welding is greatly reduced. In contrast, if the grains of $SnO_2$ are larger, then the pellet is more malleable and withstands shock well, and its contact resistance becomes lower; however the risk of dynamic welding is then greatly increased.

Work performed by the Applicant has shown that a satisfactory compromise is obtained if the material is prepared using $SnO_2$ powder in which the particle size measured in terms of specific area using the BET method lies in the range 2 $m^2/g$ to 6 $m^2/g$.

In accordance with an essential aspect of the present invention, in order to ensure that silver grains of an appropriate fineness are also obtained, use is made of an aqueous phase precipitation process in which silver oxide is precipitated in an aqueous suspension of tin oxide having the required grain size.

A concrete example of implementing this preparation method is described below.

EXAMPLE

A powder of silver and tin oxide is prepared using an aqueous phase precipitation process for precipitating silver oxide $Ag_2O$ in a suspension of tine oxide powder having the above-indicated grain size.

The principle is as follows: the desired quantity of powdered tin oxide is added to an aqueous solution of silver nitrate. The silver oxide is precipitated by adding a strong base such as sodium hydroxide to this solution, giving rise to the following reaction:

$$(AgNO_3)+(NaOH)\rightarrow><AgOH>+(NaNO_3) \quad (1)$$

in which ( ) designate species in solution; and

< > designate insoluble species.

Silver hydroxide AgOH is unstable and gives rise to silver oxide in accordance with the following reaction:

$$2<AgOH>\rightarrow><Ag_2O>+(H_2O) \quad (2)$$

In order to obtain fine grains of $Ag_2O$, it is necessary, in this method:

to operate at low temperature, e.g. about 0° C to 40° C, and in particular at ambient temperature;

to use very highly concentrated solutions; and to cause the sodium hydroxide to react with the silver nitrate quickly and uniformly, thus requiring continuous stirring of the solution and rapid addition of the sodium hydroxide.

After the reaction, the resulting product is a suspension of $Ag_2O$ (possibly together with AgOH depending on how far reaction (2) has progressed) together with $SnO_2$ in water having a high concentration of $Na^+$ and $NO_3^-$ ions.

These ions are eliminated by successive washing and separation operations.

After the last separation operation, a paste is obtained containing 20% to 95% water, and this is eliminated by drying using any appropriate method such as drying by heating or in a vacuum. A powder is thus obtained.

If drying is performed by adding heat, it is important to perform drying as quickly as possible in order to limit the growth of silver oxide grains.

In the resulting powder, it is then necessary to convert the silver oxide into metallic silver. This operation is performed by heat treatment which reduces the silver oxide at a temperature of about 200° C to 500° C. This stage also makes it possible to agglomerate the powder, thereby making it easily dispensible in an automatic machine.

Preferably, the quantities of silver nitrate and tin oxide in the starting solution are such that the final material contains about 84% to 92% by weight silver, with the remainder being constituted by silver oxide.

There follows a description of preferred methods of manufacturing contact pellets or bars incorporating the contact material obtained as described above.

A contact pellet is conventionally constituted by an underlayer of pure silver having a thickness of a few hundred micrometers (μm), thereby making it possible to solder the pellet onto its support, together with a layer of contact material having a thickness of 1 mm to 3 mm, for example.

These two types of component (underlayer and pellet) are conventionally assembled by compression, sintering, and calibration, thereby giving very good adherence qualities.

However, it turns out that such a prior process is not well adapted to the new contact material of the invention. The two components being pressed together turn out to behave quite differently during sintering: the underlayer of silver sinters to the theoretically expected density with a small reduction in volume, whereas the layer of $AgSnO_2$ sinters with a major reduction in volume while nevertheless not reaching the theoretical density. As a result, after sintering, pellets are markedly dome-shaped.

In addition, because of the brittleness of the $AgSnO_2$ contact portion of the pellet, excessive deformation during the sintering process causes the pellet to crack when subsequently subjected to further compression in order to make it plane (calibration).

In accordance with an aspect of the present invention, pellets are manufactured by a sequence of steps enabling said pellets to be brought to their maximum density progressively. More precisely, according to the invention, the following sequence of steps is used:

compression at about 3 metric tons per square centimeter ($t/cm^2$);

sintering for 30 min to 40 min at a temperature of about 840° C;

first calibration at about 10 $t/cm^2$;

first annealing for about 30 min at about 900° C;

second calibration at about 12 $t/cm^2$; and second annealing for about 30 min at about 940° C.

This method is advantageous in that the increases in density are obtained essentially during the compression and calibration operations. This means that the high temperature sintering of the material is very slow and that few bonds are formed between the silver grains. The resulting pellets are indeed more brittle, but the brittleness remains sufficiently low for the electrical behavior to be better than with a contact material of the silver-cadmium oxide type.

In accordance with another essential aspect of the invention there follows a description of a second method of manufacturing pellets including the novel contact material described above.

It should be observed, that unlike the first method of manufacture in which the final product is not suitable for rolling, this method makes it possible to provide contacts in the form of bars. It also makes it possible to reduce the number of steps required for manufacture.

In accordance with the invention, a liquid phase sintering technique is used, thereby considerably increasing both sintering speed and the quality of the resulting sintering.

More precisely, a liquid phase is created having a very low content of the $AgSnO_2$ material to be sintered. The grains are thus immersed in a liquid which means that much quicker changes are possible while still retaining the shape of the part.

By way of concrete example, the liquid phase is obtained by adding copper oxide CuO to the composite prior to sintering. It has not been possible to determine whether the resulting liquid is a mixture of Ag/0 or of Ag/Cu/0, but it has nevertheless been verified that the liquid phase is formed in air at about 940° C, i.e. 20° C below the melting point of silver.

The copper oxide is preferably added at a concentration lying between 0.1% and 1.0% by weight, e.g. about 0.2%. Remarkable pellet sintering is then observed by raising them to a temperature lying between the liquid formation temperature, i.e. 940° C, and the melting point of silver, i.e. 960° C. For example, a temperature of about 940° C to 950° C may be selected. In a few minutes, the real density of the $Ag/SnO_2$ mixture becomes practically equal to its theoretical density. In addition, in spite of the relatively fine initial grain size, a highly malleable material is obtained, thereby considerably simplifying the subsequent operations, e.g. calibrating individual pellets or rolling bars.

In accordance with another preferred characteristic, the desired concentration of copper oxide is added during the precipitation stage described above with respect to the method of obtaining the contact material. To this end, the necessary quantity of copper is added in the form of copper nitrate $Cu(NO_3)_2$ which is put into solution at the same time as the silver nitrate. In a manner analogous to that which occurs for silver, a reaction then takes place between the sodium hydroxide and the copper giving $Cu(OH)_2$, which is transformed into CuO during the heat treatment of the powder.

This provides optimum dispersion of the CuO in the mixture and consequently obtains a uniform spread of the liquid formed therein and a uniform bonding effect between grains during sintering.

It should be observed here that the copper oxide is added in sufficient quantity for sintering to take place in the liquid phase, but that this quantity is so low that the copper oxide has little influence on the electrical behavior of the resulting pellet or bar.

With the above-described improvement in the method of manufacturing pellets, an advantageous sequence of steps may be as follows:

compression at 3 $t/cm^2$;

liquid phase sintering at 940° C; and calibration at 12 $t/cm^2$.

If necessary, a final annealing step may be added to release the stresses due to calibration.

In order to make pellets from bars, the following succession of steps may be used:

compression at about 2 $t/cm^2$ to 3 $t/cm^2$;

liquid phase sintering at 940° C;

a succession of rolling and annealing operations for obtaining the desired section; and cutting up into pellets.

Table I below compares the performance of two contact pellets obtained in accordance with the two manufacturing methods described above (samples 1 and 2), with two contact pellets made using prior art contact materials, namely a material having silver and 12% cadmium oxide, and a commercially available material comprising silver, tin oxide, and tungsten oxide (samples A and B).

All of the pellets were of the same size.

In a first test (100A Test), a contact was opened while passing 100 amps rms and closed under a current of 600 amps rms, with an identical predetermined bounce for all of the samples.

After each closure operation, the force required to open the contacts was measured (the dynamic welding force), as was the contact resistance, and at three occasions during the test contact erosion was measured by weighing and is expressed in terms of weight loss per closure/opening operation.

In a second test at 1000 A, the contacts were closed under 1000 amps rms and opened under zero current. The same measurements were performed.

It can be seen that for each type of measurement the pellets made in accordance with the invention are better than at least one of the prior art pellets, and that this improvement is more highly marked in the 1000 A test.

Naturally the present invention is not limited in any way to the above description, and the person skilled in the art will be capable of making variants and modifications in accordance with the spirit of the invention.

TABLE I

| | | 100A Test | | 1000 A Test | | |
|---|---|---|---|---|---|---|
| Sample | Substance (% weight) | Erosion rate* | 99.99% weld force N | Erosion rate* | 95% weld force N | Contact Resistance in mohms |
| 1 | $Ag/SnO_2$ 12% | 9 | 12 | 6 | 32 | 0.38 |

TABLE I-continued

| Sample | Substance (% weight) | 100A Test Erosion rate* | 100A Test 99.99% weld force N | 1000 A Test Erosion rate* | 1000 A Test 95% weld force N | Contact Resistance in mohms |
|---|---|---|---|---|---|---|
| 2 | Ag/$SnO_2$ 12% /CuO 0.2% | 11 | 12 | 9 | 25 | 0.34 |
| A | Ag/CdO 12% | 26 | 12 | 62 | 67 | 0.13 |
| B | commercial Ag/$SnO_2$/$WO_3$ | 10 | 10 | 172 | 26 | 0.43 |

*Erosion rate expressed in μg per closing and opening operation for each pair of contacts.

What is claimed is:

1. A method of preparing a contact material constituted by silver and tin oxide, the method comprising the following steps:

preparing an aqueous solution containing dissolved silver nitrate and tin oxide particles in suspension, with the size of said particles measured in terms of specific surface area using the BET method lying between about 2 $m^2/g$ and 6 $m^2/g$;

causing silver nitrate to precipitate in silver hydroxide by rapidly adding a strong base and stirring, with silver hydroxide being unstable and transforming progressively into silver oxide;

eliminating the ions from the solution and then the water in order to obtain a dry product; and heating the dry product to a temperature of about 200° C to 500° C in order to reduce the silver oxide to metallic silver.

2. A method according to claim 1, wherein the concentration of silver in the final contact material is about 84% to 92% by weight, with the remainder being tin oxide.

3. A method according to claim 1, wherein the strong base is concentrated sodium hydroxide.

4. A method according to claim 1, wherein the step of heating the dry product is performed at a temperature and for a duration such as to cause the silver and the tin oxide to agglomerate.

5. A method of manufacturing a contact element such as a pellet incorporating the material prepared by the method according to claim 1, together with a thin underlayer of pure silver, wherein the material had the underlayer are subjected to the following operations:

compression at about 3 $t/cm^2$;

sintering for 30 min to 40 min at a temperature of about 840° C;

first calibration at about 10 $t/cm^2$;

first annealing for about 30 min at about 900° C;

second calibration at about 12 $t/cm^2$; and second annealing for about 30 min at about 940° C.

6. A method according to claim 5, for manufacturing pellets of contact material, and including a subsequent step of calibration by compression.

7. A method according to claim 6, including a final annealing step for releasing stresses.

8. A method according to claim 5, for manufacturing bars from which pellets can be cut off, wherein the method further includes at least one succession of rolling and annealing steps.

9. A method of manufacturing a contact element incorporating the material prepared by the method according to claim 1, together with a thin underlayer of pure silver, wherein the method comprises the following steps:

adding a low concentration of copper oxide to the prepared material; and compressing the resulting material together with said underlayer in order to form said element, and heating the said element to a temperature lying between 940° C and 960° C, thereby giving rise to a minority liquid phase in which the element is sintered.

10. A method according to claim 9, wherein the copper oxide is present in the prepared material at a concentration of about 0.1% to 1.0% by weight.

11. A method according to claim 9, for manufacturing pellets, and including a subsequent step of calibration by compression.

12. A method according to claim 11, including a final annealing step for releasing stresses.

13. A method according to claim 9, for manufacturing bars from which pellets can cut off, wherein the method further includes at least one succession of rolling and annealing steps.

* * * * *

PRINTER'S TRIM LINE

UNITED STATES PATENT AND TRADEMARK OFFICE

CERTIFICATE OF CORRECTION

PATENT NO. : 4,971,754

DATED : November 20, 1990

INVENTOR(S) : Gerard Fontet et al.

It is certified that error appears in the above-identified patent and that said Letters Patent is hereby corrected as shown below:

ON TITLE PAGE: Item [30]

Foreign Application Priority Data

Nov. 22, 1988 (FR) France 88 15163

Signed and Sealed this

Fourth Day of August, 1992

*Attest:*

DOUGLAS B. COMER

*Attesting Officer*

*Acting Commissioner of Patents and Trademarks*